US011519143B1

(12) United States Patent
Lowe

(10) Patent No.: US 11,519,143 B1
(45) Date of Patent: Dec. 6, 2022

(54) REVERSIBLE REFLECTIVE PAVEMENT MARKER

(71) Applicant: Harry E. Lowe, Schaumburg, IL (US)

(72) Inventor: Harry E. Lowe, Schaumburg, IL (US)

( * ) Notice: Subject to any disclaimer, the term of this patent is extended or adjusted under 35 U.S.C. 154(b) by 146 days.

(21) Appl. No.: 17/156,514

(22) Filed: Jan. 22, 2021

Related U.S. Application Data

(60) Provisional application No. 62/965,052, filed on Jan. 23, 2020.

(51) Int. Cl.
*E01F 9/50* (2016.01)
*E01F 9/553* (2016.01)
*E01F 9/524* (2016.01)

(52) U.S. Cl.
CPC ..... *E01F 9/553* (2016.02); *E01F 9/524* (2016.02)

(58) Field of Classification Search
CPC ..... E01F 9/524; E01F 9/553
USPC ..... 404/13, 16
See application file for complete search history.

(56) References Cited

U.S. PATENT DOCUMENTS 3,049,980 A 8/1962 Gill, Jr.
4,195,945 A 4/1980 Heenan
4,557,624 A 12/1985 Walker
4,653,955 A * 3/1987 Racs ..... E01F 9/553 D10/113.1
5,277,513 A 1/1994 Flanagan et al.
D354,246 S * 1/1995 Weid ..... D10/113.1
5,470,170 A 11/1995 Lindner
5,564,854 A 10/1996 Hedgewick
5,662,430 A * 9/1997 Lee ..... E01F 9/553 404/15
6,045,294 A * 4/2000 Hansen ..... E01F 9/553 404/16
6,109,821 A * 8/2000 Montalbano ..... E01F 9/553 404/9
6,579,035 B1 * 6/2003 Watson ..... E01F 9/559 404/9
6,776,555 B2 8/2004 Kuo
6,811,729 B2 11/2004 Attar
6,955,497 B2 10/2005 Snagel et al.
7,001,100 B1 2/2006 Attar
7,037,033 B1 5/2006 Attar
8,425,144 B2 * 4/2013 Bjorklund ..... E01C 23/22 404/16
9,567,717 B2 2/2017 Intagliata
2003/0113081 A1 * 6/2003 Melby ..... A41D 27/085 385/901

(Continued)

*Primary Examiner* — Gary S Hartmann
(74) *Attorney, Agent, or Firm* — John C. Shepard

(57) ABSTRACT

Reflective pavement markers held fixedly to a roadway by epoxy or adhesive include reflectors and a body with spaced top and bottom mounting faces, transverse forward and rearward faces, and lateral side faces. A recess formed in the forward and rearward faces of the body may receive and vertically mount a reflector therewithin. The reflectors have vertical outer faces that are orthogonal to the body mounting faces and angled 30°±15° relative to an orthogonal line from a lateral side face such that the marker generally has a parallelepiped shape. An array of openings, which may be closed or open, extend inwardly into the body from the top and bottom faces and have constricted openings to positively lock in the fixing adhesive and prevent the marker from easily lifting from the pavement.

19 Claims, 10 Drawing Sheets

(56) References Cited

U.S. PATENT DOCUMENTS

| | | | | |
|---|---|---|---|---|
| 2004/0234335 | A1* | 11/2004 | Snagel | E01F 9/553 404/16 |
| 2006/0165961 | A1* | 7/2006 | Tsutsui | G09F 13/16 428/192 |
| 2009/0097915 | A1 | 4/2009 | Hedgewick | |

* cited by examiner

REVERSIBLE REFLECTIVE PAVEMENT MARKER

CROSS REFERENCE TO RELATED APPLICATION

This application claims the benefit of and priority from U.S. Provisional Application Ser. No. 62/965,052 filed 23 Jan. 2020, the disclosures of which are herein incorporated by reference in their entireties.

BACKGROUND OF THE INVENTION

Technical Field

The present invention relates to reflectors and, more particularly, to reflective pavement markers.

Background Art

Pavement markers provide visible delineation of center lines, edge lines, turning lanes, ramps, and the like. Pavement markers must withstand damage from vehicle traffic, snowplows, and sundry environmental factors. Presently, two types of pavement markers are generally being used, namely, raised markers and recessed markers.

A typical raised marker utilizes a heavy iron casting embedded within a pavement cutout. The casting has raised laterally spaced inclined longitudinal keels or rails, and a reflector held between and at a lower height than the rails. While the casting is embedded in the pavement, both the rails and reflector protrude slightly above the pavement surface. Raised markers have been used extensively in snow-belt states, as the rails effectively guide the snowplow up and over the reflector. However, many raised marker castings are often dislodged from the pavement, which then potentially become heavy projectiles capable of causing both vehicle damage and personal injury. In fact, some states have already demanded increased inspection of raised markers and/or their removal.

Recessed markers, which are being increasingly specified in highway construction, are mounted below the pavement surface in long narrow line-of-sight grooves that allow vehicle headlight rays to illuminate the reflector. Recessed markers typically have reflector assemblies that are held in plastic bodies. The plastic bodies are positioned in the grooves and fixed to the roadway pavement by epoxy or other suitable adhesive.

With roadway exposure, reflectors can become detached from roadway pavement. This may be because of weather, environmental conditions and frequent vehicle impacts. As a result, reflectors and/or bodies periodically require replacement, which adds to the overall cost of roadway maintenance.

BRIEF SUMMARY OF THE INVENTION

The present invention is directed to overcoming one or more of the problems as set forth above.

It is one object of the present invention to provide a pavement marker that is easy to install and is durable.

It is a further object of the present invention to provide a pavement marker that is effective and inexpensive.

It is a further object of the present invention to provide a pavement marker that is mounted and interlocked with adhesive used to secure it to the pavement.

It is a further object of the present invention to reduce material cost, reduce manufacturing complexities, and eliminate unnecessary components.

It is a further object of the present invention to provide a marker that is self-washing and minimizes damage from vehicle impact.

In an exemplary embodiment, a marker includes a body and reflectors with the marker having top and bottom planar mounting faces, planar lateral side faces orthogonal to the mounting faces, and planar forward and rearward transverse faces orthogonal to the mounting faces and angled relative to the lateral side faces. The markers have reflector faces that are vertically upright to the roadway and lateral sides parallel to the direction of vehicle travel.

A feature of some embodiments of the marker herein is that one or more reflectors has upright lenses that may be mounted in recesses in the forward and rearward sides of the body to form transverse vertical forward and rearward faces of the marker.

A further feature of the marker herein is an array of tapered openings, which may be closed or open, extending inwardly into the body from the top and bottom surfaces into which adhesive may flow during marker installation.

BRIEF DESCRIPTION OF THE SEVERAL VIEWS OF THE DRAWINGS

The details of construction and operation of the invention are more fully described with reference to the accompanying drawings which form a part hereof and in which like reference numerals refer to like parts throughout.

In the drawings.

Figure 1:
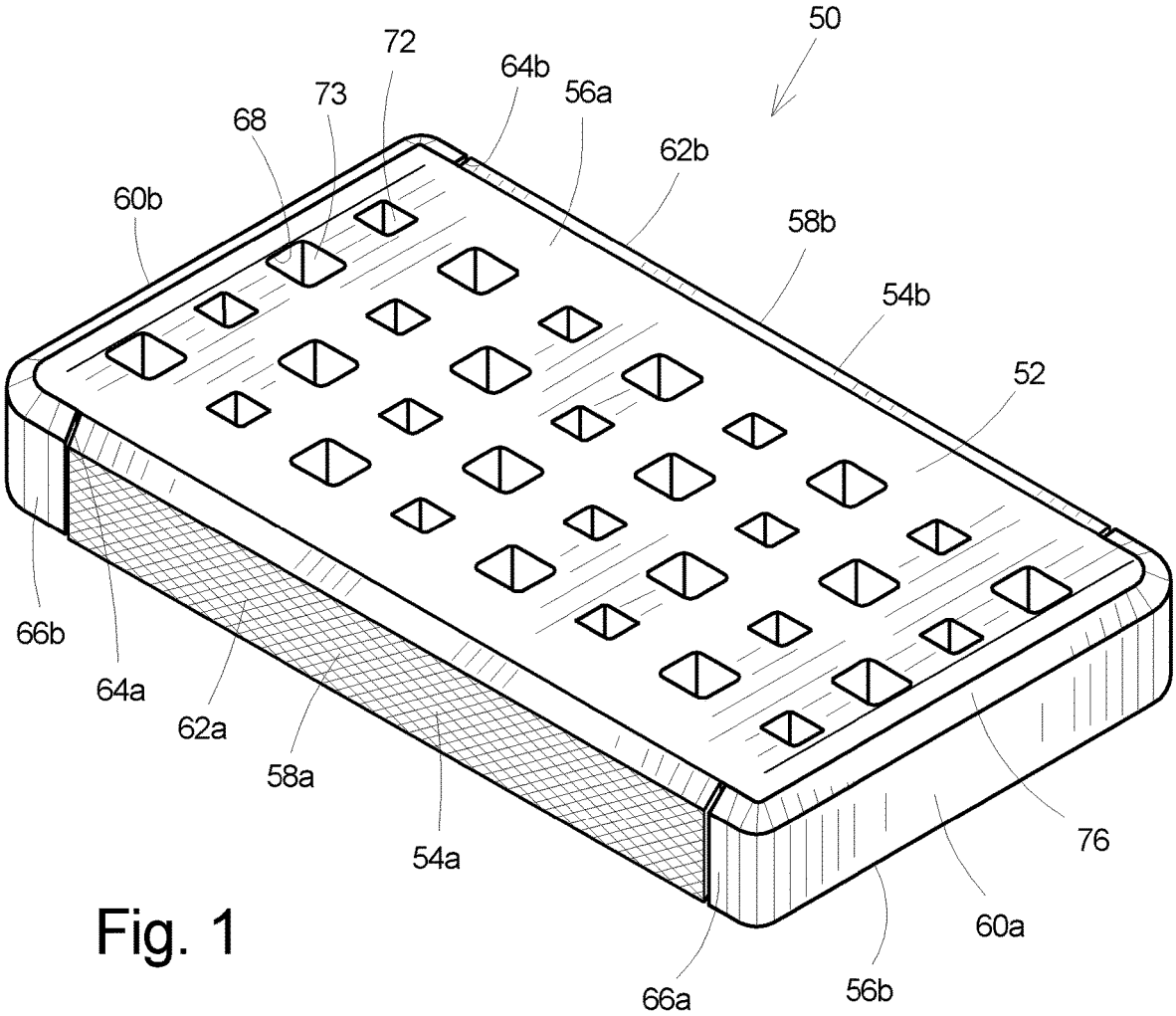
FIG. 1 is a perspective top view of a first embodiment of a pavement marker showing a 4 by 8 array of tapering rectangular through openings.
Figure 2:
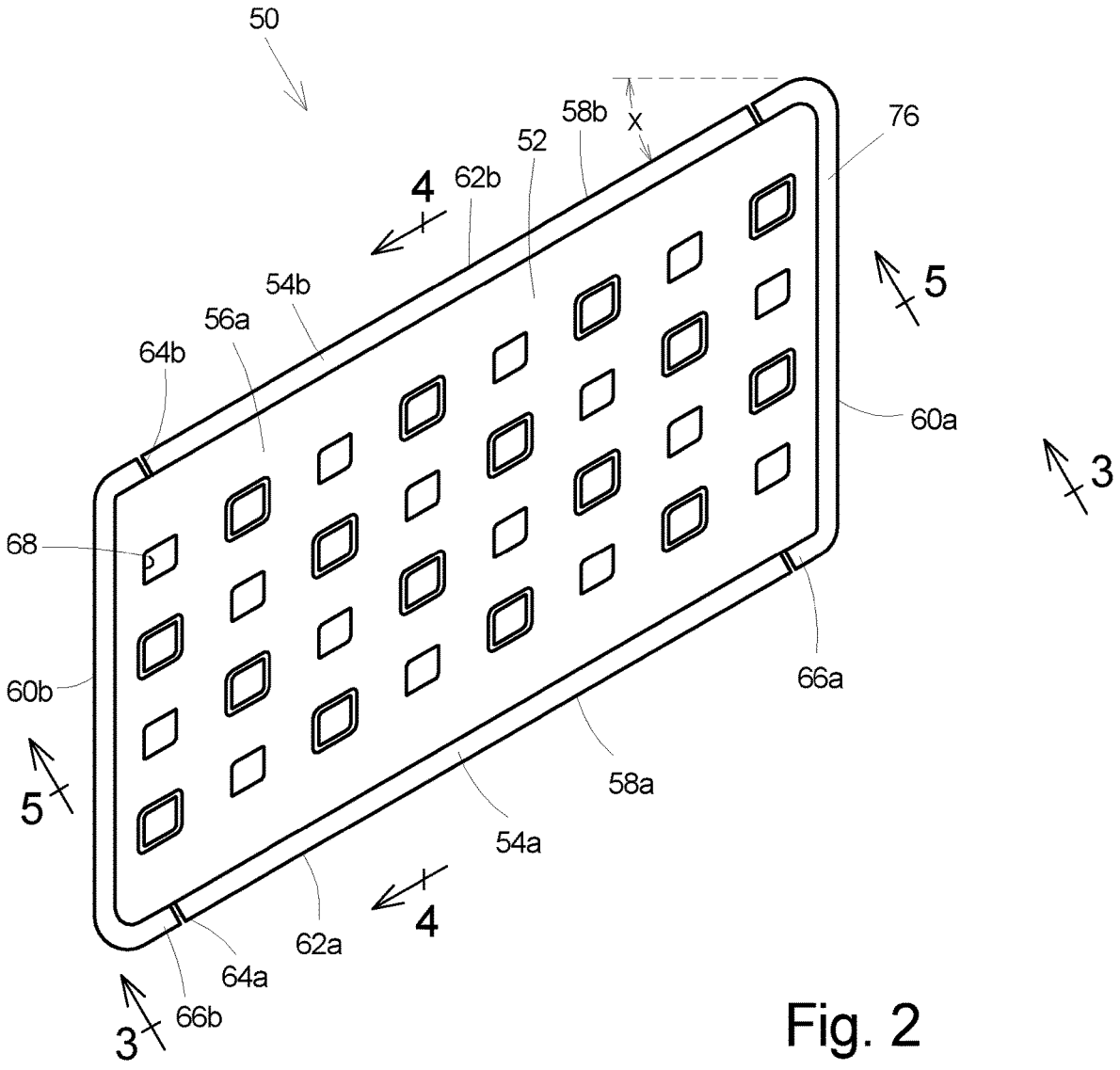
FIG. 2 is a top plan view of the pavement marker shown in FIG. 1.
Figure 3:
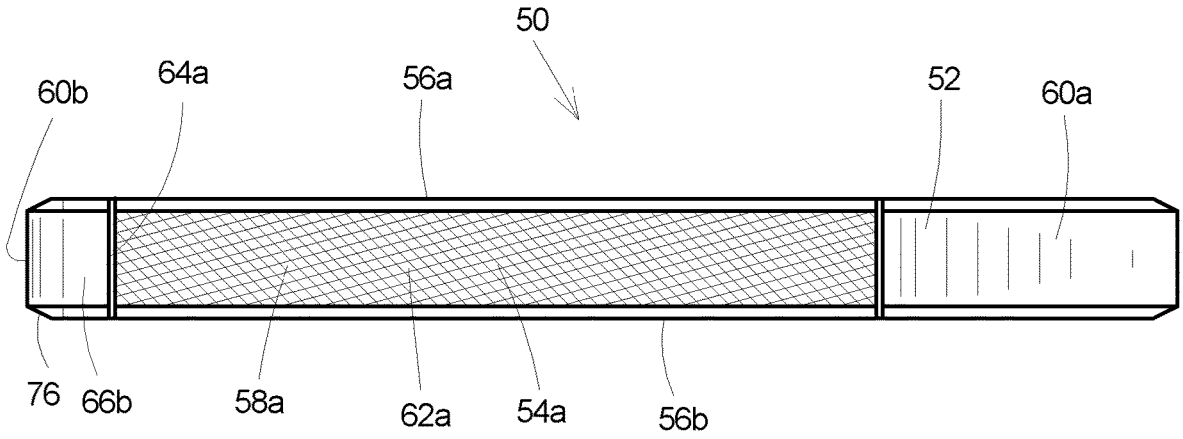
FIG. 3 is a front elevational view taken along line 3-3 of the pavement marker shown in FIG. 2.
Figure 4:
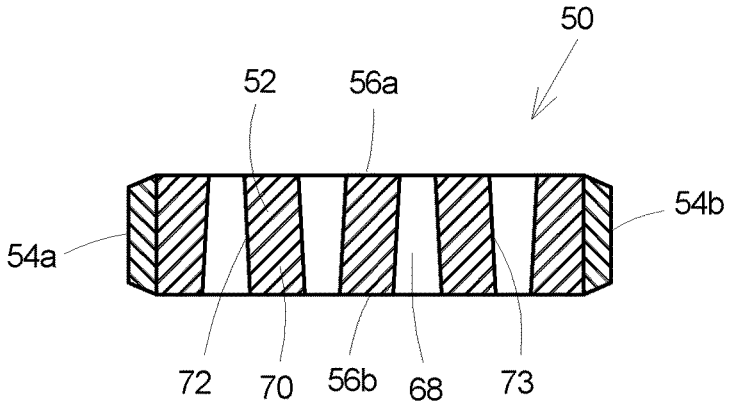
FIG. 4 is a cross-sectional view taken along line 4-4 of the pavement marker shown in FIG. 2.
Figure 5:
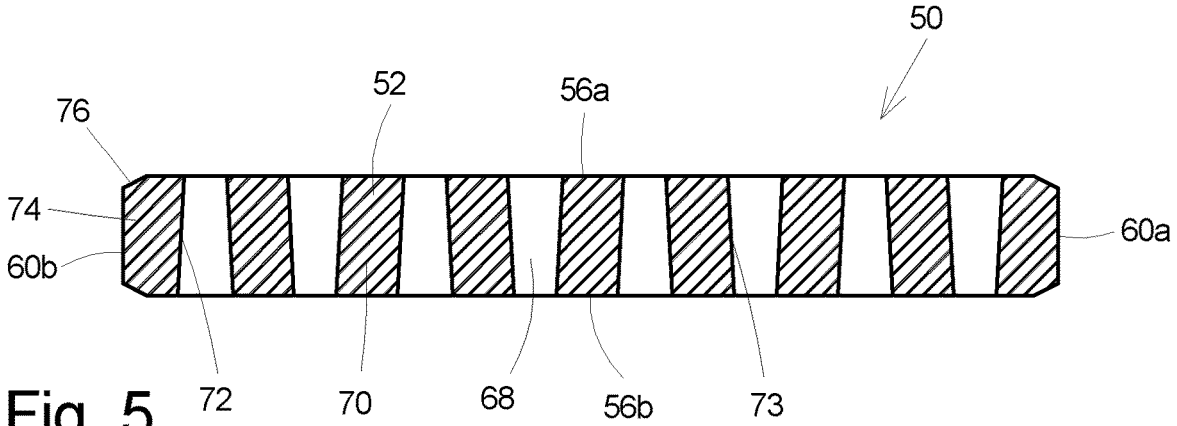
FIG. 5 is a cross-sectional view taken along line 5-5 of the pavement marker shown in FIG. 2.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood.

DETAILED DESCRIPTION OF THE PREFERRED EMBODIMENTS

While the present invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Herein, the terms "reflector" and "reflector lens" are used interchangeably with the term "reflector face" being the outer surface of the reflector.

In FIGS. 1-5, a reflective pavement marker, generally designated 50, is seen to include a holder, or body 52, and a pair of reflectors 54*a*,54*b* fixed to the body 52. The marker 50 has a pair of vertically-spaced parallel planar mounting faces 56*a*,56*b*, longitudinally-spaced parallel planar transverse forward and rearward outer faces 58*a*,58*b* extending vertically between the forward and rearward edges of the mounting faces 56*a*,56*b*, and a pair of laterally-spaced parallel planar lateral side faces 60*a*,60*b* respectively extending vertically between the spaced lateral edges of the mounting faces 56*a*,56*b*.

The forward and rearward faces 58*a*,58*b* and the lateral side faces 60*a*,60*b* are orthogonal to the mounting faces 56*a*,56*b*. The mounting faces 56*a*,56*b* define the top and bottom of the body 52. The forward and rearward faces 58*a*,58*b* define the front and rear of the marker 50. The lateral side faces 60*a*,60*b* define the left and right lateral sides of the body 52 and the marker 50.

The forward and rearward outer faces 58*a*,58*b* are spaced apart longitudinally with the length of the marker 50 being defined by the distance between the forward and rearward faces 58*a*,58*b*. The lateral side faces 60*a*,60*b* are spaced apart laterally with the width of the marker 50 being defined by the distance between the lateral side faces 60*a*,60*b*. The vertical distance between the mounting faces 56*a*,56*b* define the height of the marker 50

Each reflector 54*a*,54*b* is fixed to one of the forward and rearward sides (not numbered) of the body 52 with the reflector outer faces 62*a*,62*b* generally forming the upright vertical forward and rearward faces of the marker 50. The reflector forward and rearward outer faces 62*a*,62*b* are orthogonal to the body mounting faces 56*a*,56*b* and are slanted at an acute angle x between 15° and 45°, preferably 30°, relative to an imaginary line orthogonal to the lateral side faces 60*a*,60*b*. The angled reflector lens, which is exposed to incoming light, facilitates self-washing of debris from the face of the reflector and deflects the force resulting from the impacting contact of vehicle tires, snow plows, and the like on the marker 50. The verticality of the reflector 54*a*,54*b* maximizes reflectively from a vehicle's headlights back to the vehicle driver. It is noted that the greater the slant angle the greater the cleaning action but results in less intensity of light reflection back to a vehicle driver.

The inner faces of the reflectors 54*a*,54*b* are attached to the body 52 within rectangular recesses 64*a*,64*b* formed in the forward and rearward sides of the body 52 and are bounded laterally by spaced outward projections 66*a*,66*b* extending longitudinally at the lateral sides of the body 52. The reflector outer faces 62*a*,62*b* are flush with the outermost edges of the projections 66*a*,66*b*.

Formed in the body 52 is a 4 by 8 array of rectangularly-shaped holes, or through openings, collectively designated 68, arranged in linear longitudinal and lateral or transverse rows and define a series of separating walls, or connected webs 70. The center lines of the tapered through openings 68 are orthogonal to the mounting faces 56*a*,56*b* and have a frusto-pyramidal cross-sectional configuration. The through openings 68 have upward and downward tapers arranged alternately throughout the body 52. It can be seen that the body 52 has a portion of through openings 68 with internal walls 72 extending vertically downward and radially outward and the remaining through openings 68 with internal walls 73 extending vertically downward and radially inward. There are an even number of openings in each row and an even number of similar oriented openings in each row.

The body 52 is molded as an integral one-piece unit from suitable plastic, such as polycarbonate, acrylonitrile butadiene styrene (ABS), or the like. Preferably, the webs 70 and edge walls 74 have a substantially similar cross-sectional thickness and weight permitting all elements of the body 52 to cool during molding at similar rates to minimize problems with shrinkage and distortion during molding or fabrication. The vertical edges of the body 52 are rounded over and the horizontal edges are chamfered to define small beveled surfaces 76 to ease the transition between horizontal and vertical.

The marker 50 is fixed to the surface of a roadway by suitable by epoxy or other suitable adhesive with one of the mounting faces placed horizontally so as overlie the roadway. A bed of epoxy is applied to the pavement surface and the marker 50 is pushed into it. The epoxy flows around the marker 50 and upwardly into the through openings 68. The epoxy adhesively fixes the body 52 to the roadway with the reflector faces vertically oriented by bonding with the mounting surface and the internal walls of the through openings 68 for increased agglutination. In a portion of the through openings 68, the taper of the through openings 68 shapes the epoxy into enlarged internally disposed ends, or mushrooms, positively locking the body 52 within the epoxy and to the roadway and supplementing the adhesive bond of the epoxy present between the opposed body and roadway surfaces. The outer ends of some through openings 68 have a narrowing or constricting aperture to prevent the marker 50 from being easily lifted off the deformed upright fingers created in the bed of epoxy.

The body 52 may also be disposed within an elongate recess cut into the roadway as described in my United States patent application entitled "Snowplowable Pavement Marker," Ser. No. 16/258,253, filed Jan. 25, 2019.

Figure 6:
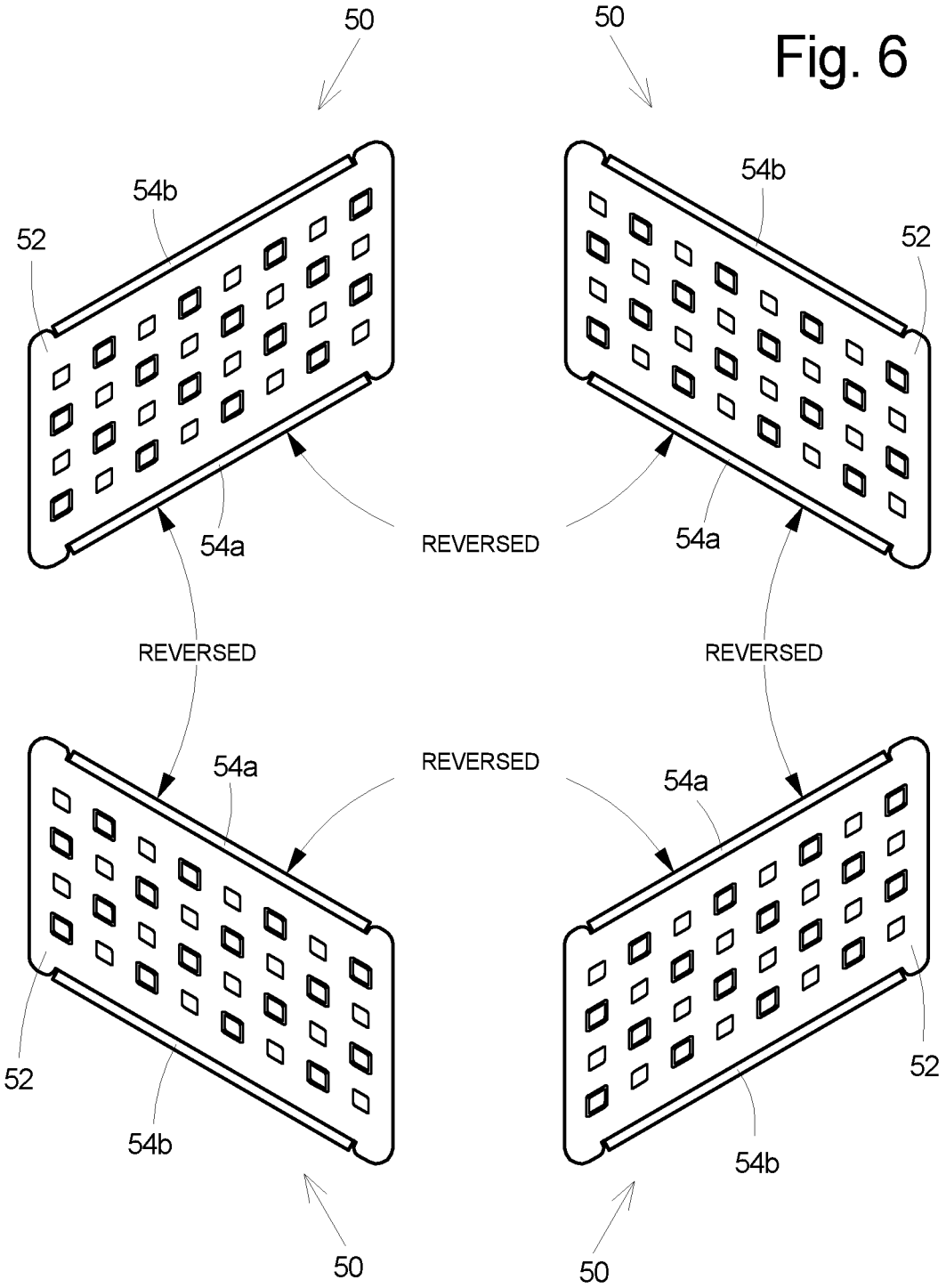
FIG. 6 is a plan diagram illustrating the various orientations of a pavement marker when it is reversed or flipped over.

As best seen in FIG. 6, the marker 50 is generally in the shape of a 6-sided parallelepiped with opposite sides being parallel. In this manner, the marker 50 may be reversed, flipped, or rotated about a longitudinal or lateral axis so that the top may become the bottom, the front may become the rear, and the left side may become the right side. Regardless of the orientation of the marker 50, the lateral side faces can be aligned so as to be parallel to roadway direction with a mounting surface on the pavement. Whatever the orientation of the marker 50, the effectiveness of the epoxy fixing it to the pavement or the intensity of its reflectivity remains the same, since the face of the reflector remains vertical although the angular direction of the reflector may be altered relative to vehicle direction. This symmetric configuration allows the marker 50 to be used on the left and right sides of a roadway to demarcate the lanes in a roadway. The face of the reflector remains vertical (orthogonal to the base) and angled 30°±15° from an imaginary cross line that is at a right angle or orthogonal to road direction.

Figures 7, 8:
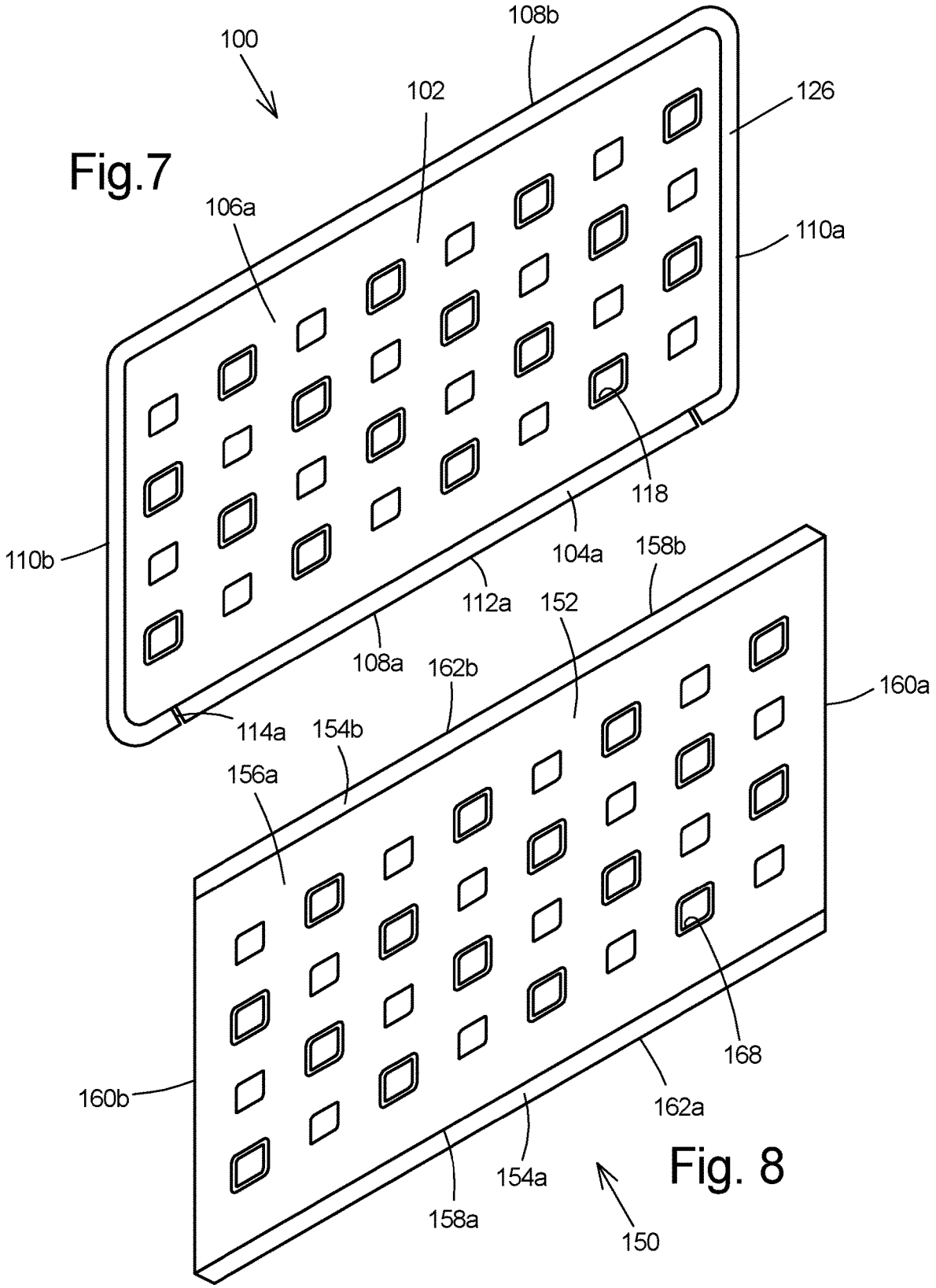
FIG. 7 is a top plan view of a second embodiment of a pavement marker showing a marker with a single reflector mounted to the body.
FIG. 8 is a top plan view of a third embodiment of a pavement marker showing a marker with the reflectors extending to the lateral sides of the body.

In FIG. 7, a reflective pavement marker, generally designated 100, is seen to include a body 102 and a single reflector 104*a*. The marker 100 has top and bottom mounting faces, one of which is shown and is designated 106*a*, slanted transverse forward and rearward faces 108*a*,108*b*, and a pair of lateral side faces 110*a*,110*b*. In this embodiment, one side of the body 102 has a recess 114*a* for one reflector having a lens face 112*a* that defines one face 108*a* of the marker 100. The opposite side of the body 102 has no recess and is flat to define the other face 108*b* of the marker 100.

Similar to the embodiment shown in FIGS. 1-5, the body 102 has a 4 by 8 array of rectangularly-shaped through openings, collectively designated 118. The through openings 118 are orthogonal to the mounting faces 106*a* and have a frusto-pyramidal cross-sectional configuration. The through openings 118 have upward and downward tapers arranged alternately throughout the body 102. The upper and lower exposed edges of the body have a chamfer 126 easing the edges.

The marker 100 shown in FIG. 7 as well as the other markers disclosed herein may be used singly, or in groups of two or more, as the particular circumstance requires.

In FIG. 8, a reflective pavement marker, generally designated 150, is seen to include a body 152 and a pair of reflectors 154*a*,154*b*. The marker 150 has top and bottom mounting faces, one of which is shown and is designated 156*a*, slanted transverse forward and rearward reflector faces 158*a*,158*b*, and a pair of lateral side faces 160*a*,160*b*. In this embodiment, the forward and rearward sides of the body 152 have no recesses and the transverse reflectors 154*a*,154*b* extend outward to the lateral side faces 160*a*, 160*b* of the body 152 with the reflector faces 162*a*,162*b* being vertically orthogonal relative to the mounting faces 156*a*.

Similar to the embodiment shown in FIGS. 1-5, the body 152 has a 4 by 8 array of rectangularly-shaped through openings, collectively designated 168. The through openings 168 are orthogonal to the mounting faces 156 and have a frusto-pyramidal cross-sectional configuration. The through openings 168 have upward and downward tapers arranged alternately throughout the body 152. The upper and lower exposed edges of the body 152 have no chamfer.

Figure 9:
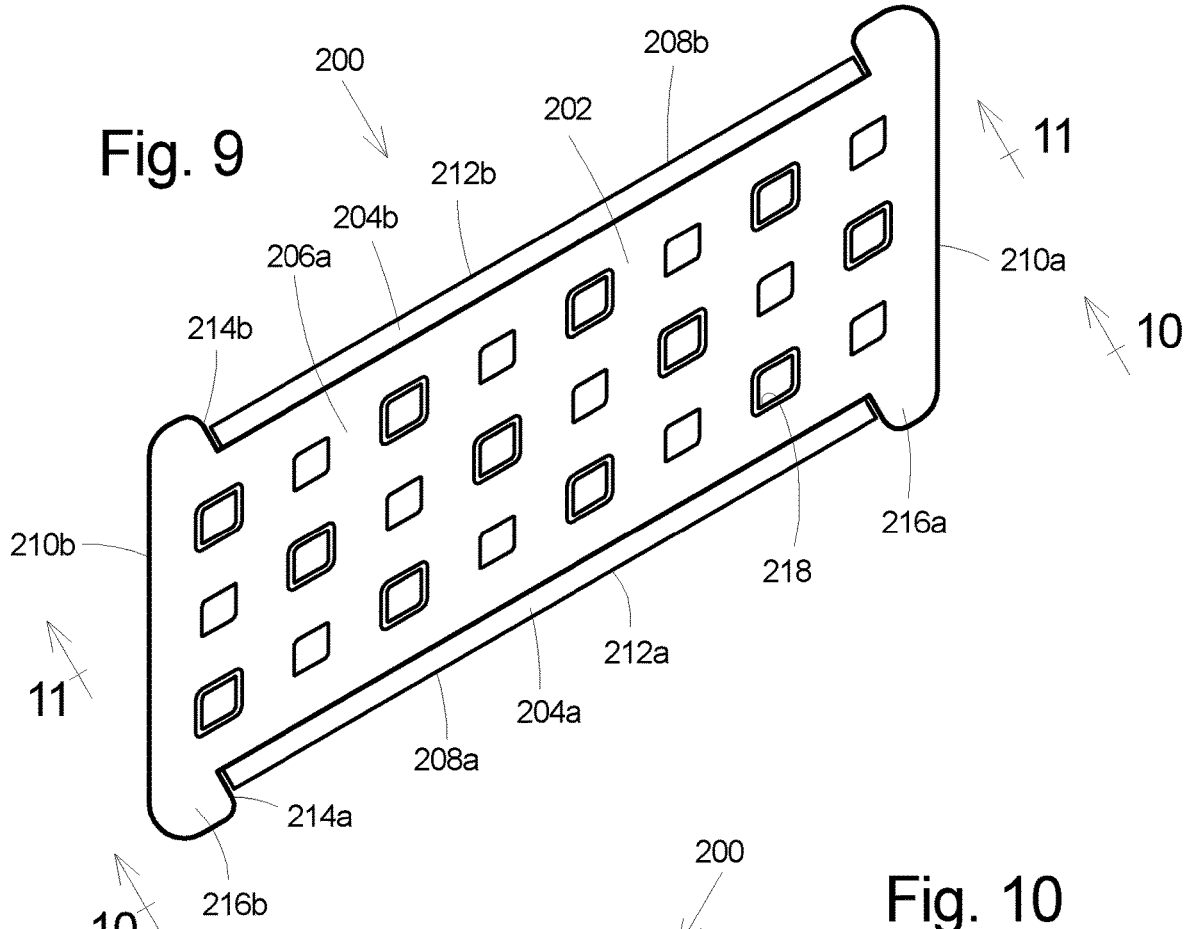
FIG. 9 is a top plan view of a fourth embodiment of a pavement marker showing a 3 by 8 array of tapering rectangular through openings.
Figure 10:
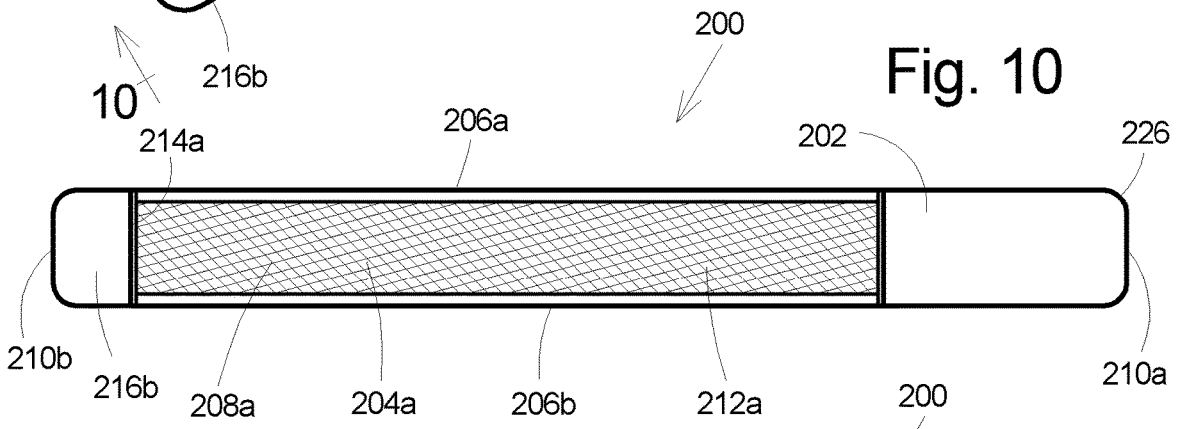
FIG. 10 is a front elevational view taken along line 10-10 of the pavement marker shown in FIG. 9.
Figure 11:
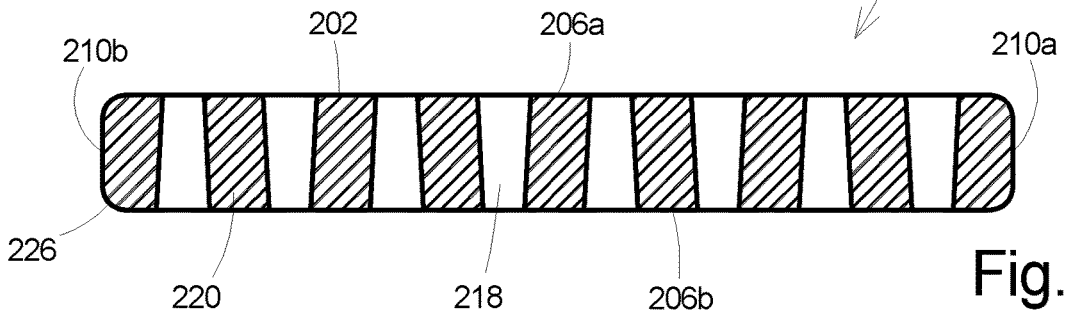
FIG. 11 is a cross-sectional view taken along line 11-11 of the pavement marker shown in FIG. 9.

In FIGS. 9-11, a reflective pavement marker, generally designated 200, is seen to include a body 202 and a pair of reflectors 204*a*,204*b*. The marker 200 has top and bottom mounting faces 206*a*,206*b*, slanted transverse forward and rearward faces 208*a*,208*b*, and a pair of lateral side faces 210*a*,210*b*. The rectangular reflectors 204*a*,204*b* are fixed to the body 202 within rectangular recesses 214*a*,214*b* formed in the forward and rearward sides of the body 202 between spaced projections 216*a*,216*b* with the transverse reflector faces 212*a*,212*b* being set back inward from the outward edge of the projections 216*a*,216*b* and being vertically orthogonal relative to the mounting faces 206*a*,206*b*.

FIGS. 9-11 illustrate the concept that there may be any number of through openings. Herein, the body has a 3 by 8 array of rectangularly-shaped through openings, collectively designated 218, that are linearly-aligned and define a series of connected webs 220. The through openings 218 are orthogonal to the mounting faces 206*a*,206*b* and have a frusto-pyramidal cross-sectional configuration. The through openings 218 have upward and downward tapers arranged alternately throughout the body 202. The upper and lower exposed edges 226 of the body 202 are rounded easing the edges.

Figure 12:
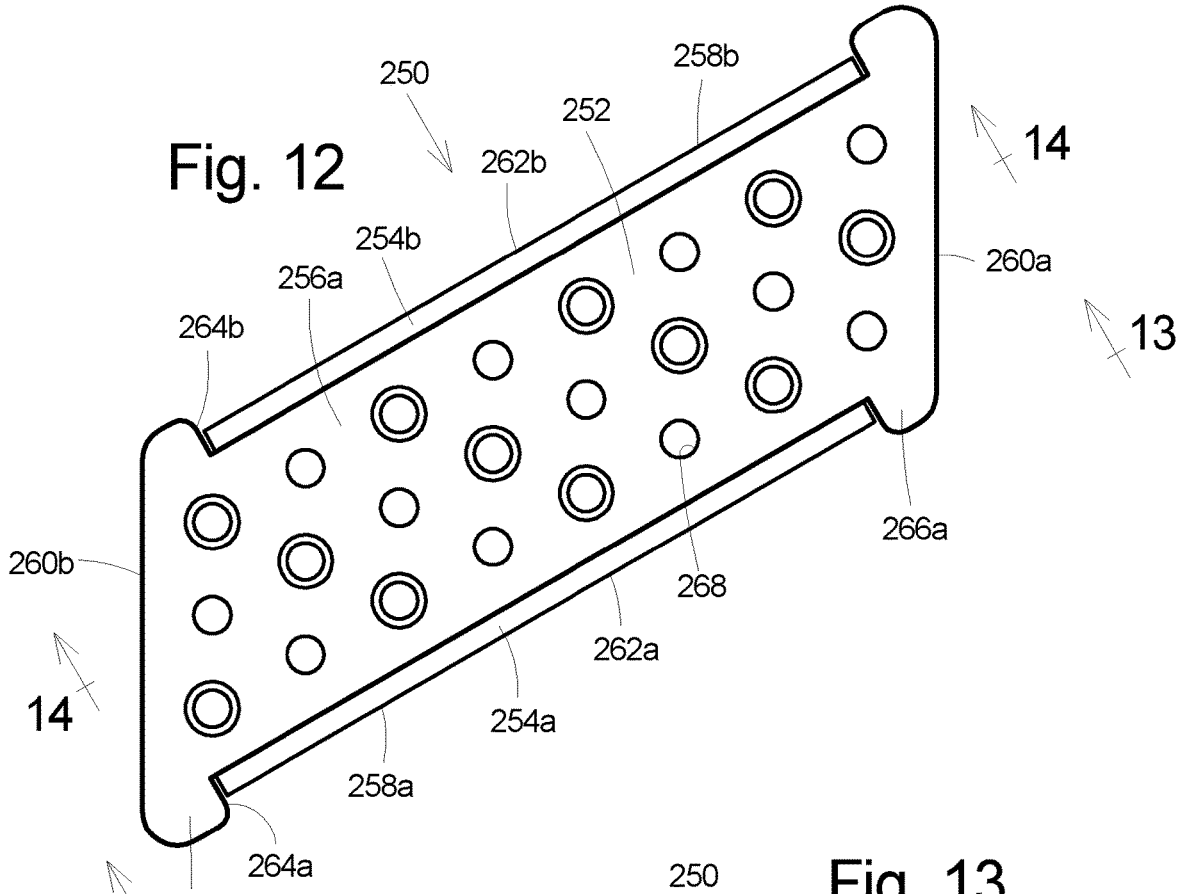
FIG. 12 is a top plan view of a fifth embodiment of a pavement marker showing a 3 by 8 array of tapering circular through openings.
Figure 13:
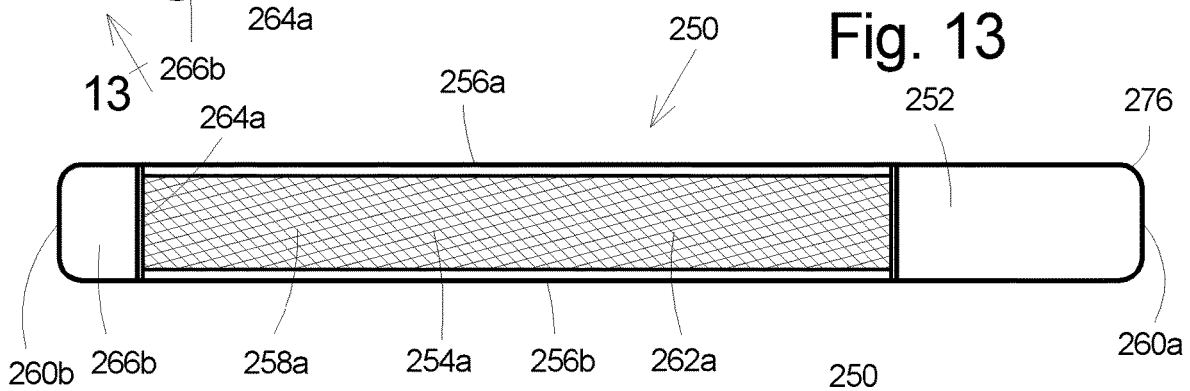
FIG. 13 is a cross-sectional view taken along line 13-13 of the pavement marker shown in FIG. 12.
Figure 14:
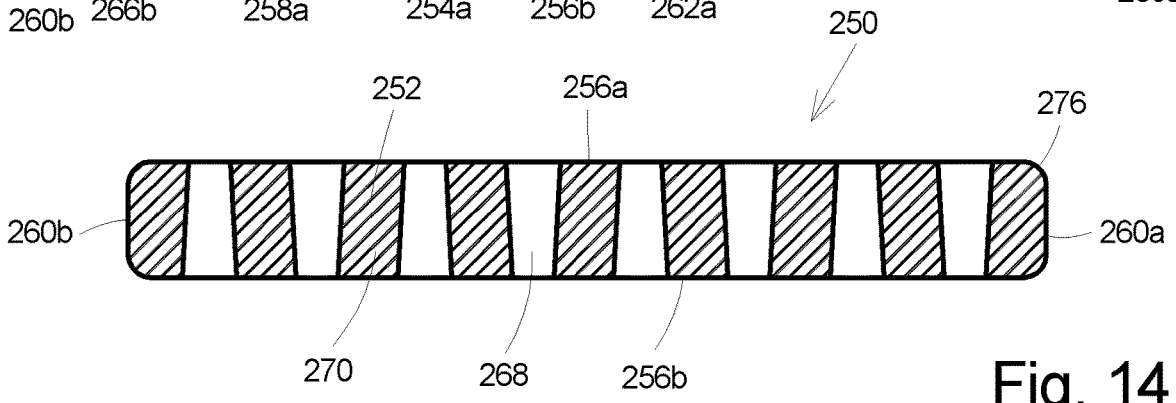
FIG. 14 is a cross-sectional view taken along line 14-14 of the pavement marker shown in FIG. 12.

In FIGS. 12-14, a reflective pavement marker, generally designated 250, is seen to include a body 252 and a pair of reflectors 254*a*,254*b*. The body 252 has top and bottom mounting faces 256*a*,256*b*, slanted transverse forward and rearward faces 258*a*,258*b*, and a pair of lateral side faces 260*a*,260*b*. The rectangular reflectors 254*a*,254*b* are fixed to the body 252 within rectangular recesses 264*a*,264*b* formed in the forward and rearward sides of the body 252 between spaced projections 266*a*,266*b* with the transverse reflector faces 262*a*,262*b* being set back from the outward edge of the projections 266*a*,266*b* and being vertically orthogonal relative to the mounting faces 256*a*,256*b*.

FIGS. 12-14 illustrate the concept that the openings may have many different cross-sectional configurations. Herein, the body 252 has a 3 by 8 array of circularly-shaped through openings, collectively designated 268, that define a series of connected webs 270. The through openings 268 are orthogonal to the mounting faces 256*a*,256*b* and have a frusto-conical cross-sectional configuration. The through openings 268 have upward and downward tapers arranged alternately throughout the body 252. The upper and lower exposed edges 276 of the body 242 are rounded easing the edges.

Figure 15:
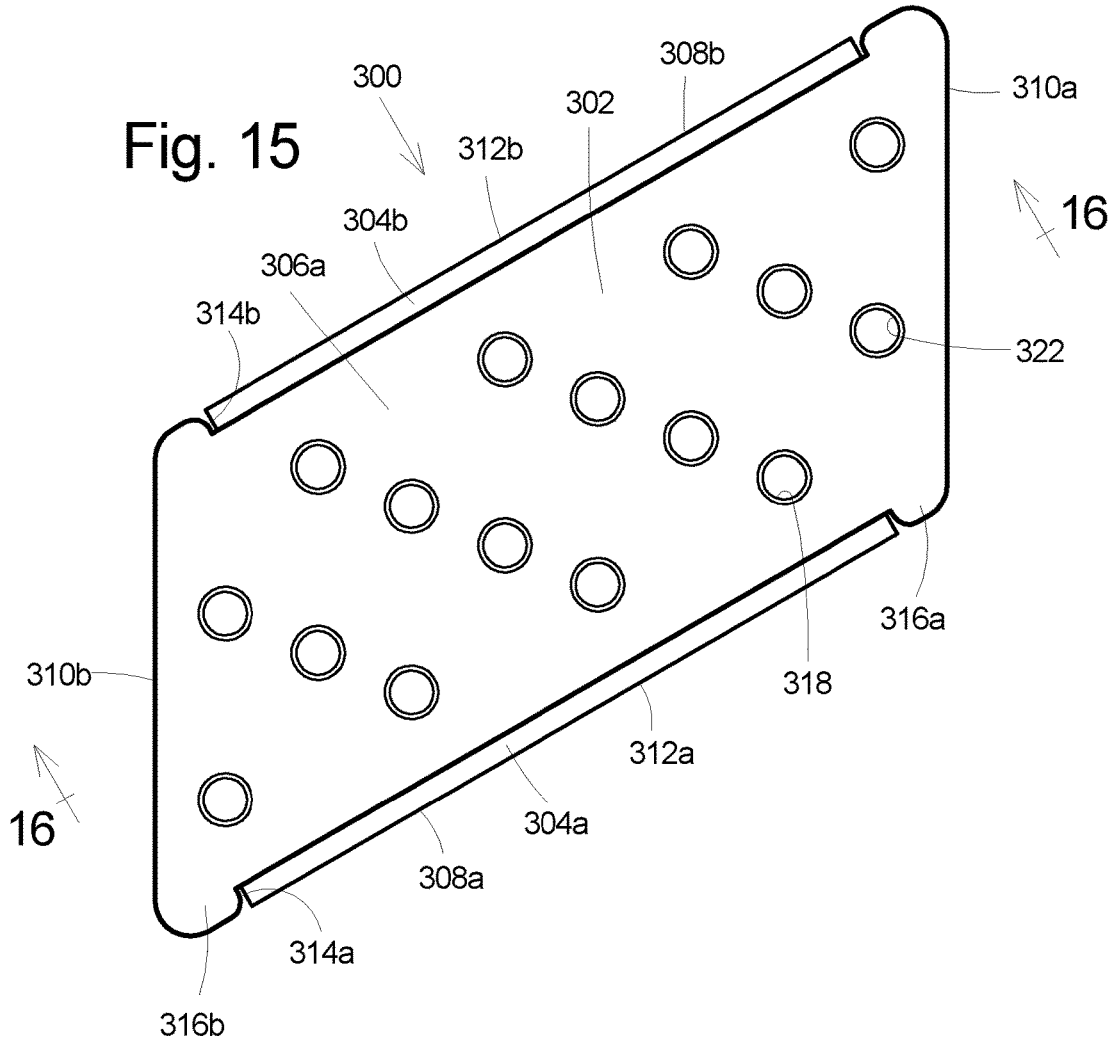
FIG. 15 is a top plan view of a sixth embodiment of a pavement marker showing a 4 by 8 array of tapering circular closed openings.
Figure 16:
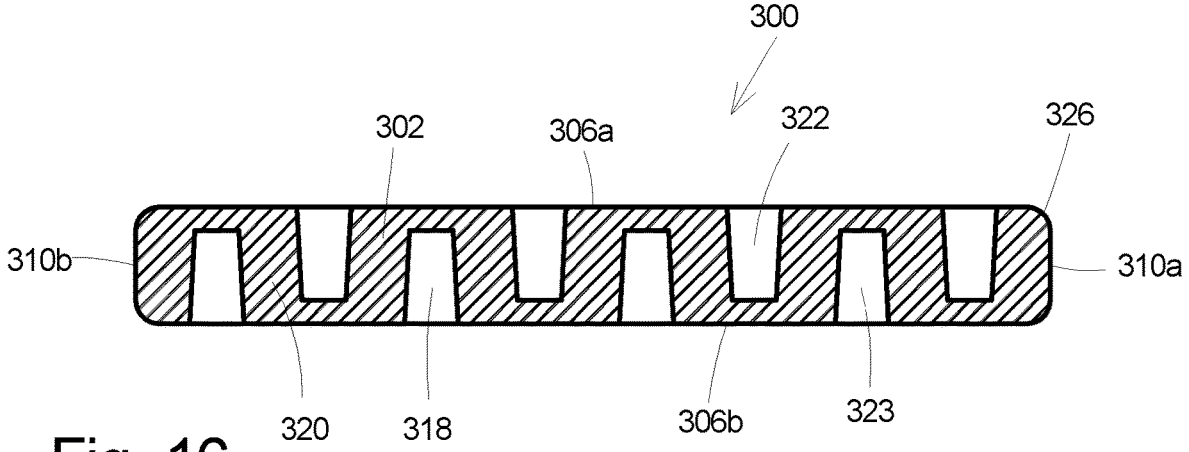
FIG. 16 is a cross-sectional view taken along line 16-16 of the pavement marker shown in FIG. 15.

In FIGS. 15 and 16, a reflective pavement marker, generally designated 300, is seen to include a body 302 and a pair of reflectors 304*a*,304*b*. The marker 300 has top and bottom mounting faces 306*a*,306*b*, slanted transverse forward and rearward faces 308*a*,308*b*, and a pair of lateral side faces 310*a*,310*b*. The rectangular reflectors 304*a*,304*b* are fixed to the body 302 within rectangular recesses 314*a*,314*b* formed in the forward and rearward sides of the body 302 between spaced projections 316*a*,316*b* with the reflector faces 312*a*,312*b* being flush with the outward edge of the projections 316*a*,316*b* and vertically orthogonal relative to the mounting faces 306*a*,306*b*.

FIGS. 15 and 16 illustrate the concept that the openings may be formed as closed or blind holes wherein the openings do not break through the opposite face. Herein, the body 302 has a 4 by 8 array of circularly-shaped tapered openings, collectively designated 318, that define a series of connected webs 320 with the openings 318 being vertically orthogonal to the mounting faces 306*a*,306*b* and having a frusto-conical cross-sectional configuration. A portion, collectively designated 322, of the openings 318 extend inwardly from the top mounting face 306*a* terminating short of the bottom mounting face 306*b* while the remainder, collectively designated 323, of the openings 318 extend inwardly from the bottom mounting face 306*b* terminating short of the top mounting face 306*a*. The openings 318 are alternately arranged upwardly and downwardly throughout the body 302. The upper and lower exposed edges 326 of the body 302 are rounded easing the edges.

Figure 17:
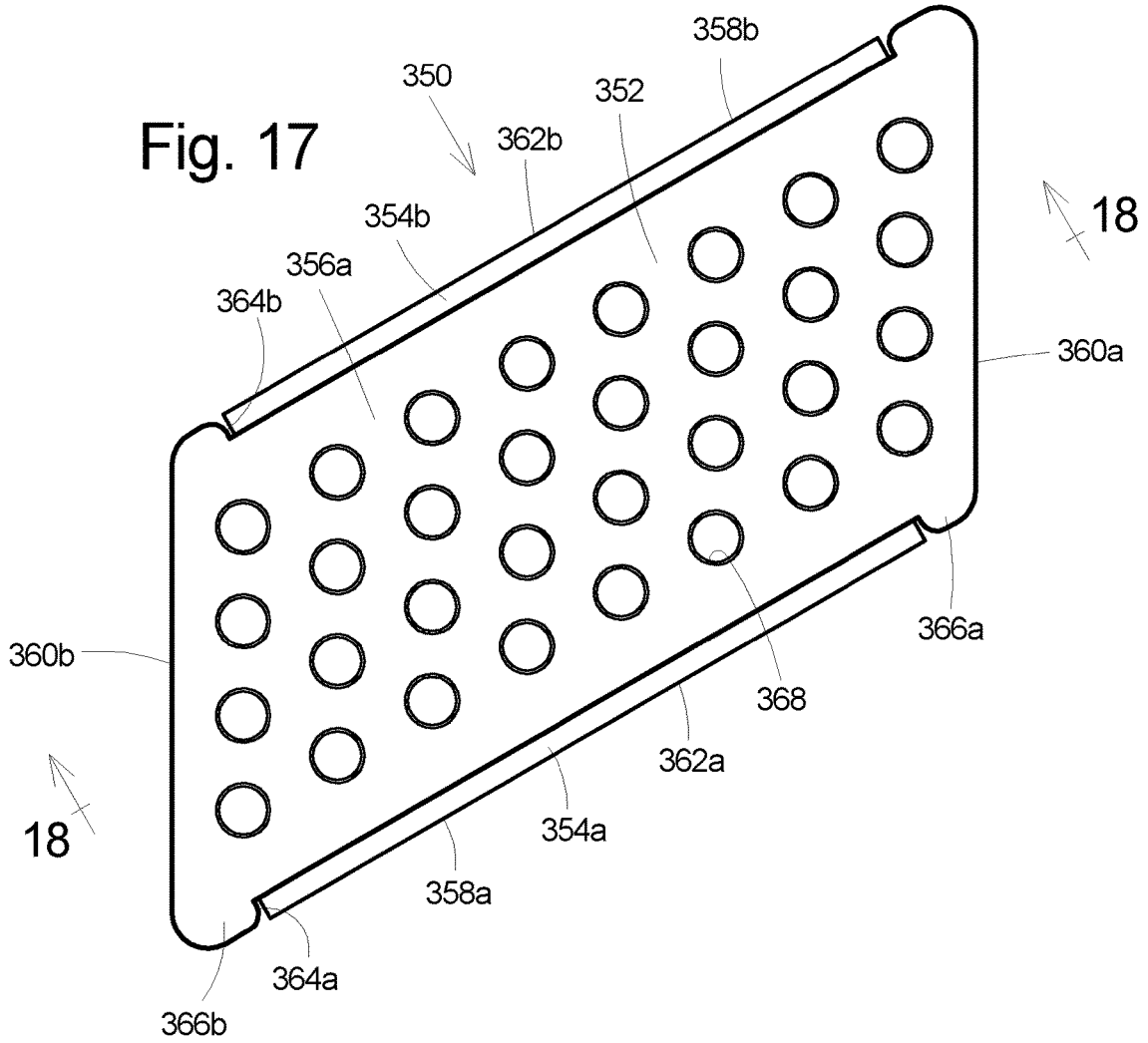
FIG. 17 is a top plan view of a seventh embodiment of a pavement marker showing a 4 by 8 array of double tapering hourglass-shaped through openings.
Figure 18:
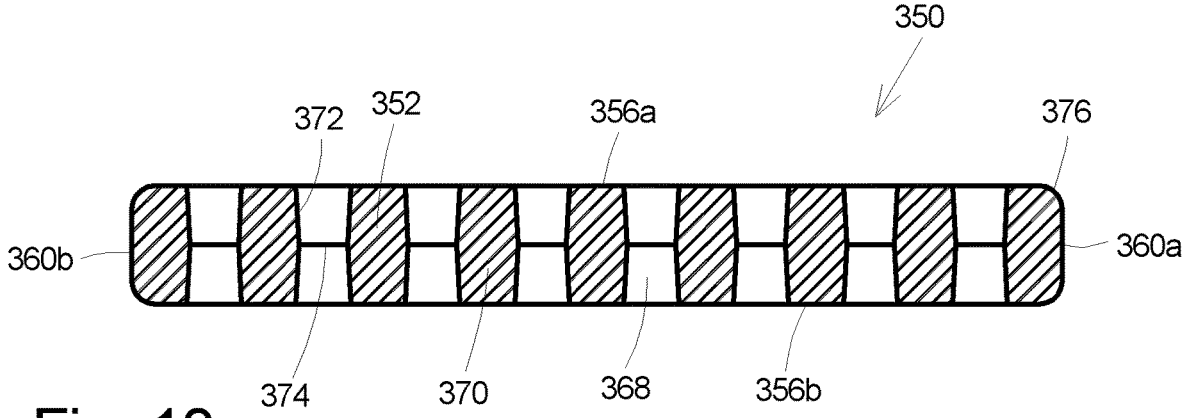
FIG. 18 is a cross-sectional view taken along line 18-18 of the pavement marker shown in FIG. 17.

In FIGS. 17 and 18, a reflective pavement marker, generally designated 350, is seen to include a body 352 and a pair of reflectors 354*a*,354*b*. The marker 352 has top and bottom mounting faces 356*a*,356*b*, slanted transverse forward and rearward faces 358*a*,358*b*, and a pair of lateral side faces 360*a*,360*b*. The rectangular reflectors 354*a*,354*b* are fixed to the body 352 within rectangular recesses 364*a*,364*b* formed in the forward and rearward sides of the body 352 between spaced projections 366*a*,366*b* with the reflector faces 362*a*,362*b* being flush with the outward edge of the projections 366*a*,366*b* and vertically orthogonal relative to the mounting faces 356*a*,356*b*.

FIGS. 17 and 18 illustrate the concept that the openings may have different cross-sectional configurations. Herein, the body 352 has a 4 by 8 array of hourglass-shaped through openings, collectively designated 368, that define a series of connected webs 370. The through openings 368 are orthogonal to the mounting faces 356*a*,356*b* and have a constricted center section. The internal walls 372 of the openings 368 extend inwardly from each of the mounting faces 356*a*,356*b* tapering to an intermediate constriction 374. The upper and lower exposed edges 376 of the body 352 are rounded easing the edges.

Figure 19:
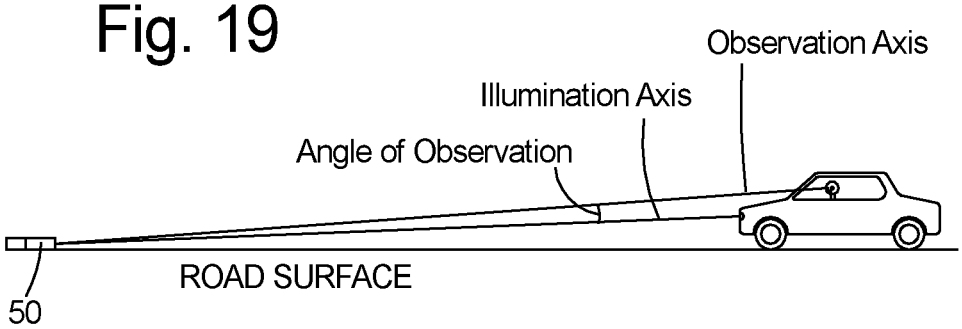
FIG. 19 is a side elevational diagram of a car on a roadway showing a headlight beam reflecting off a pavement marker; and, FIG. 20 is a top plan diagram of a car on a roadway showing a headlight beam reflecting off a pavement marker.
Figure 20:
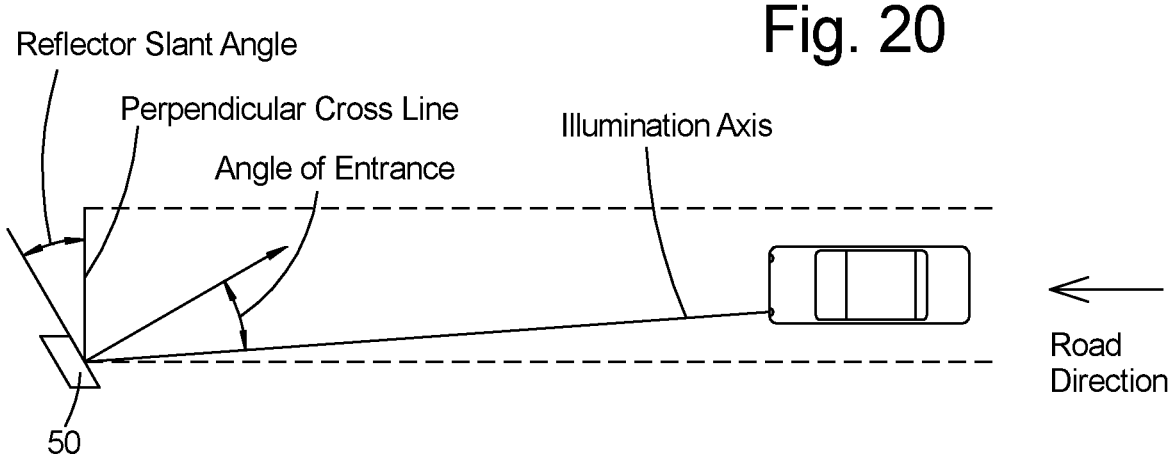

In FIGS. 19 and 20, the placement of a pavement marker is shown as well as the path of a light beam from a car headlight to and from the reflector. The illumination axis extends from the headlight to the marker. The observation axis extends from the marker reflector to the driver. The angle of entrance is the angle between a orthogonal to the reflector face and the illumination axis. The angle of observation is the angle between the illumination axis and the observation axis. The cross line is a transverse line orthogonal to road direction. The reflector slant angle is the angle between the cross line and the vertical face of the reflector lens.

INDUSTRIAL APPLICABILITY

From the foregoing, it will be observed that numerous variations and modifications may be effected without departing from the spirit and scope of the invention. It will also be observed that the various elements of the invention may be in any number of combinations, and that all of the combinations are not enumerated here. It will be understood that no limitation with respect to the specific apparatus illustrated herein is intended or should be inferred. While specific embodiments of the invention have been disclosed, one of ordinary skill in the art will recognize that one can modify the materials, dimensions and particulars of the embodiments without straying from the inventive concept.

Other aspects, objects and advantages of this invention can be obtained from a study of the drawings and the foregoing disclosure.

It should be understood that the terms "top," "bottom," "forward," "rear," "rearward," "upper," "lower," "inner," "outer," "side," "end," "horizontal," "vertical," and similar terms as used herein, have reference only to the structure shown in the drawings and are utilized only to facilitate describing the invention. The terms and expressions employed herein have been used as terms of description and not of limitation.

As used herein, the term "longitudinal" shall mean in the direction of travel and generally parallel to the side face of the marker; the term "lateral" shall mean in the direction across the direction of travel and generally orthogonal to the side edges of the marker; the term "axial" refers to a direction or line that is longitudinal and substantially straight; the term "transverse" refers to a direction other than the axial direction (e.g., orthogonal or nonorthogonal); and, the term "within" shall mean "to be partially or completely inside of."

What is claimed is:

1. A reflective pavement marker having at least one transverse side to reflect light towards roadway traffic, the marker comprising:

a body having a pair of vertically-spaced, parallel mounting faces, a pair of longitudinally-spaced transverse faces, and a pair of laterally-spaced parallel side faces, the transverse faces and the side faces being vertically orthogonal to the mounting faces;

at least one reflector having spaced inner and outer faces, the inner face being fixed to one of the transverse faces of the body intermediate the side faces, the outer face facing outward from the marker forming a transverse side of the marker and being orthogonal to the mounting faces and slanted at an acute angle relative to a line orthogonal to the side faces;

the body having a plurality of holes extending from each of the mounting faces inwardly into the body; and, whereby the marker is fixed to the roadway by adhesive disposed in the holes and between the roadway and a lower mounting face.

2. The reflective pavement marker of claim 1 wherein the acute angle is between 15° and 45°.

3. The reflective pavement marker of claim 1 wherein the outer face of the at least one reflector forms a transverse side of the marker.

4. The reflective pavement marker of claim 1 wherein the marker has two reflectors with each reflector forming a transverse side of the marker.

5. The reflective pavement marker of claim 1 wherein laterally spaced projections extend longitudinally outward from the body to define a recess in the body adapted to receive the at least one reflector.

6. The reflective pavement marker of claim 1 wherein the holes are closed openings terminating within the body.

7. The reflective pavement marker of claim 1 wherein the holes are through openings extending from one of the mounting faces to the other of the mounting faces.

8. The reflective pavement marker of claim 1 wherein the holes extend orthogonally inward from the mounting faces of the body.

9. The reflective pavement marker of claim 1 wherein the holes are tapered with a portion of each hole being constricted relative to another portion of the hole.

10. The reflective pavement marker of claim 9 wherein a portion of the holes taper in one direction and another portion of the holes taper in an opposite direction.

11. The reflective pavement marker of claim 1 wherein the plurality of holes is an array of holes with at least two rows of holes intermediate the transverse faces being linearly aligned and extending longitudinally and at least two rows of holes intermediate the lateral side faces being linearly aligned and extending transversely.

12. The reflective pavement marker of claim 11 wherein the number of holes in a row extending longitudinally between the transverse faces is an even number and the number of holes in a row extending transversely between the lateral side faces is an even number.

13. The reflective pavement marker of claim 11 wherein each hole longitudinally or laterally adjacent to another hole is tapered in an opposite direction.

14. The reflective pavement marker of claim 1 wherein the holes are spaced an equal distance apart to form internal walls separating adjacent holes that are of similar thickness.

15. The reflective pavement marker of claim 1 wherein the body is made of plastic.

16. The reflective pavement marker of claim 15 wherein the body is made of polycarbonate.

17. The reflective pavement marker of claim 1 wherein the marker is generally parallelepiped-shaped.

18. A reflective pavement marker having at least one transverse side to reflect light towards roadway traffic, the marker comprising:

a plastic body having a pair of vertically-spaced, parallel mounting faces, a pair of longitudinally-spaced transverse faces, and a pair of laterally-spaced parallel side faces, the transverse faces and the side faces being vertically orthogonal to the mounting faces;

at least one reflector having spaced inner and outer faces, the inner face being fixed to one of the transverse faces of the body intermediate the side faces, the outer face forming a transverse side of the marker facing outward from the marker and being orthogonal to the mounting faces and slanted at an acute angle relative to a line orthogonal to the side faces between 15° and 45°;

the body having a plurality of holes extending from each of the mounting faces inwardly into the body, the holes being tapered with a portion of the holes tapering in one direction and another portion of the holes tapering in an opposite direction; and, whereby the marker is fixed to the roadway by adhesive disposed in the holes and between the roadway and a lower mounting face.

19. The reflective pavement marker of claim 18 wherein a portion of the holes taper in one direction and another portion of the holes taper in an opposite direction, and wherein the holes are linearly aligned in longitudinal and transverse rows with the number of holes in a longitudinal row is an even number and the number of holes in a transverse row is an even number.

* * * * *